US008133569B2

(12) United States Patent
Penfield

(10) Patent No.: US 8,133,569 B2
(45) Date of Patent: Mar. 13, 2012

(54) FOLDED SHEET MATERIAL AND ARRAY OF FOLDED SHEET MATERIALS

(75) Inventor: Robert Michael Penfield, Marietta, GA (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 335 days.

(21) Appl. No.: 12/543,730

(22) Filed: Aug. 19, 2009

(65) Prior Publication Data

US 2010/0055391 A1 Mar. 4, 2010

Related U.S. Application Data

(60) Provisional application No. 61/092,429, filed on Aug. 28, 2008.

(51) Int. Cl.
*B32B 3/04* (2006.01)

(52) U.S. Cl. ..... 428/124; 428/130

(58) Field of Classification Search ..... 428/124, 428/130; 221/48, 47; 206/494
See application file for complete search history.

(56) References Cited

U.S. PATENT DOCUMENTS

| | | | | |
|---|---|---|---|---|
| 1,427,420 | A | 8/1922 | Sargent | |
| 1,430,709 | A | 10/1922 | Wheeler | |
| 1,632,446 | A | 6/1927 | Krueger | |
| 1,666,553 | A * | 4/1928 | Christman | 270/39.08 |
| 1,682,580 | A | 8/1928 | Pratt | |
| 1,767,859 | A | 6/1930 | Shaffer | |
| 1,962,762 | A | 6/1934 | Campbell | |
| 2,050,030 | A | 8/1936 | Winter | |
| 2,244,630 | A | 6/1941 | Metternich | |
| 2,253,742 | A | 8/1941 | West et al. | |
| 2,602,013 | A | 7/1952 | Amerslav | |
| 2,626,145 | A | 1/1953 | Sabee | |
| 3,119,516 | A | 1/1964 | Donovan | |
| 3,207,360 | A | 9/1965 | Scott | |
| 3,472,504 | A | 10/1969 | Murphy et al. | |
| 3,537,446 | A | 11/1970 | Rowland, Jr. et al. | |
| 3,542,356 | A | 11/1970 | Murphy et al. | |
| 3,679,095 | A | 7/1972 | Nissen et al. | |
| 3,709,077 | A | 1/1973 | Trogan et al. | |
| 4,221,304 | A | 9/1980 | Wahl et al. | |
| 4,254,947 | A | 3/1981 | Trogan | |
| 4,270,744 | A | 6/1981 | Trogan | |
| 4,475,730 | A | 10/1984 | Trogan | |

(Continued)

FOREIGN PATENT DOCUMENTS

EP 0286538 A1 10/1988

(Continued)

OTHER PUBLICATIONS

International Search Report and Written Opinion of the International Search Authority for PCT/US2009/054272 mailed Apr. 5, 2010.

*Primary Examiner* — Alexander Thomas
(74) *Attorney, Agent, or Firm* — William W. Letson

(57) ABSTRACT

An array of sheet materials includes a first sheet, a second sheet, and an interior sheet located between the first sheet and the second sheet, each sheet having a centrally located medial primary fold formed therein and a secondary off-fold transverse thereto, the medial fold and the transverse off-fold defining four panels in each sheet.

4 Claims, 9 Drawing Sheets

U.S. PATENT DOCUMENTS

| | | | |
|---|---|---|---|
| 4,751,807 | A | 6/1988 | Couturier |
| 4,765,604 | A | 8/1988 | Trogan |
| 4,770,402 | A | 9/1988 | Couturier |
| 4,778,441 | A | 10/1988 | Couturier |
| 4,811,878 | A | 3/1989 | Horinchi |
| 4,824,426 | A | 4/1989 | DuFresne |
| 4,836,410 | A | 6/1989 | Mastrobuoni |
| 4,859,518 | A | 8/1989 | Schutz |
| 4,874,158 | A | 10/1989 | Retzloff |
| 4,877,154 | A | 10/1989 | Matsui |
| 4,917,665 | A | 4/1990 | Couturier |
| 4,997,338 | A | 3/1991 | Couturier |
| 5,065,895 | A | 11/1991 | DeLuca et al. |
| 5,118,554 | A | 6/1992 | Chan et al. |
| 5,226,611 | A | 7/1993 | Butterworth et al. |
| 5,295,579 | A | 3/1994 | Focke et al. |
| 5,299,793 | A | 4/1994 | Couturier |
| 5,300,347 | A | 4/1994 | Underhill et al. |
| 5,310,398 | A | 5/1994 | Yoneyama |
| 5,328,053 | A | 7/1994 | Cook et al. |
| 5,368,188 | A | 11/1994 | Twardowski |
| 5,379,897 | A | 1/1995 | Muckenfuhs et al. |
| 5,516,000 | A | 5/1996 | Freiburger et al. |
| D372,589 | S | 8/1996 | Burgess et al. |
| 5,565,258 | A | 10/1996 | McConnell et al. |
| 5,584,443 | A | 12/1996 | Butterworth |
| 5,643,398 | A | 7/1997 | Lumberg |
| D382,118 | S | 8/1997 | Ferrero |
| 5,690,250 | A | 11/1997 | Gooding, Jr. et al. |
| 5,716,691 | A | 2/1998 | Chan |
| 5,736,224 | A | 4/1998 | Dodge |
| 5,740,913 | A | 4/1998 | McFarland |
| 5,755,146 | A | 5/1998 | Lumberg |
| 5,772,149 | A | 6/1998 | Butterworth |
| 5,820,064 | A | 10/1998 | Butterworth |
| 5,853,845 | A | 12/1998 | McConnell et al. |
| 5,868,276 | A | 2/1999 | Loppnow et al. |
| 5,891,008 | A | 4/1999 | Bavely et al. |
| 5,941,144 | A | 8/1999 | Lumberg |
| 6,000,657 | A | 12/1999 | Butterworth |
| 6,045,002 | A | 4/2000 | Wierschke |
| 6,051,095 | A | 4/2000 | Butterworth |
| 6,090,467 | A | 7/2000 | Yip |
| 6,096,152 | A | 8/2000 | Anderson et al. |
| 6,138,543 | A | 10/2000 | Couturier |
| 6,182,418 | B1 | 2/2001 | McFarland |
| 6,213,346 | B1 | 4/2001 | Skerrett et al. |
| 6,227,086 | B1 | 5/2001 | Lumberg |
| 6,250,495 | B1 | 6/2001 | Bando |
| 6,254,522 | B1 | 7/2001 | Schmidt |
| 6,286,713 | B1 | 9/2001 | Chan et al. |
| 6,296,144 | B1 | 10/2001 | Tanaka et al. |
| 6,296,601 | B1 | 10/2001 | Couturier |
| 6,299,016 | B1 | 10/2001 | Bando et al. |
| 6,306,480 | B1 | 10/2001 | Yardley et al. |
| 6,322,315 | B1 | 11/2001 | Schmidt et al. |
| 6,352,251 | B1 | 3/2002 | DeAngelis |
| 6,372,064 | B1 | 4/2002 | Butterworth et al. |
| 6,409,881 | B1 | 6/2002 | Jaschinski |
| 6,431,038 | B2 | 8/2002 | Couturier |
| 6,488,194 | B1 | 12/2002 | Couturier |
| 6,508,153 | B1 | 1/2003 | Lumberg et al. |
| 6,539,829 | B1 | 4/2003 | Kauppila et al. |
| 6,543,643 | B2 | 4/2003 | Iida et al. |
| 6,547,909 | B1 | 4/2003 | Butterworth |
| 6,565,500 | B1 | 5/2003 | Hailey et al. |
| 6,585,129 | B2 | 7/2003 | Moody et al. |
| 6,602,575 | B2 | 8/2003 | Du Grosriez et al. |
| 6,623,833 | B2 | 9/2003 | Chan |
| 6,641,894 | B2 | 11/2003 | Bando |
| 6,644,501 | B2 | 11/2003 | Iida |
| 6,685,050 | B2 | 2/2004 | Schmidt et al. |
| 6,699,360 | B2 | 3/2004 | Heath et al. |
| 6,730,012 | B2 | 5/2004 | Bando |
| 6,753,058 | B2 | 6/2004 | Mansson |
| 6,824,007 | B2 | 11/2004 | Timmers et al. |
| 6,884,209 | B2 | 4/2005 | Roozrokh |
| 6,960,349 | B2 | 11/2005 | Shantz et al. |
| 7,097,896 | B2 | 8/2006 | Merrill |
| 7,322,489 | B2 | 1/2008 | Long |
| 7,611,765 | B2 | 11/2009 | Hochtritt et al. |
| 7,939,159 | B2 | 5/2011 | Hochtritt et al. |
| 2001/0020626 | A1 | 9/2001 | Skerrett et al. |
| 2001/0025856 | A1 | 10/2001 | Lefevre Du Grosriez et al. |
| 2001/0040107 | A1 | 11/2001 | Tourre et al. |
| 2002/0038805 | A1 | 4/2002 | Iide et al. |
| 2002/0051863 | A1 | 5/2002 | Chan |
| 2002/0060222 | A1 | 5/2002 | Bando |
| 2002/0068142 | A1 | 6/2002 | Baroni et al. |
| 2002/0070141 | A1 | 6/2002 | Iide et al. |
| 2005/0058807 | A1 | 3/2005 | Hochtritt et al. |

FOREIGN PATENT DOCUMENTS

| | | | |
|---|---|---|---|
| EP | 0302382 | A1 | 2/1989 |
| JP | 10174663 | A | 6/1998 |
| JP | 02-888616 | B2 | 2/1999 |
| KR | 20-0185018 | Y1 | 6/2000 |
| WO | 98/19951 | A1 | 5/1998 |
| WO | 01/41613 | A1 | 6/2001 |

* cited by examiner

FOLDED SHEET MATERIAL AND ARRAY OF FOLDED SHEET MATERIALS

CROSS REFERENCE TO RELATED APPLICATIONS

This application claims priority to U.S. Provisional Application No. 61/092,429 filed Aug. 28, 2008, which is herein incorporated by reference in its entirety.

BACKGROUND

The present disclosure generally relates to folded sheet materials and arrays of folded sheet materials, and more particularly, to multi-folded napkins and multi-folded napkin arrays.

With the prevalence of fast food establishments, single use dispenser napkins have become important. Single use dispenser napkins are highly desirable in the quick service restaurant industry, because they are readily dispensed and are highly sanitary but, most of all, because they are economical. Dispenser napkins are commonly found on countertops or tabletops in lunchrooms and restaurants.

In most cases, napkins employed in connection with commercial food service or the "away-from-home" markets are not purchased by the end user. Thus, the primary considerations by a purchaser of these napkins are usually cost, number of napkins that can be fit into a dispenser and dispensability characteristics. However, there are a number of problems in trying to "take-cost out" of a napkin. For example, a napkin has to be designed to be contained in a reasonably sized dispenser, be strong enough to resist tearing or tabbing during the dispensing process and also be readily removable from the dispenser.

Accordingly, a continual need exists for improved napkins and arrays of napkins that meet the customer's needs.

BRIEF SUMMARY

Disclosed herein are folded sheet materials and arrays of folded sheet materials.

In one embodiment, an array of sheet materials comprises a first sheet, a second sheet, and an interior sheet located between the first sheet and the second sheet, each sheet having a centrally located medial primary fold formed therein and a secondary off-fold transverse thereto, the medial fold and the transverse off-fold defining four panels in each sheet:

an interior major panel;

an exterior major panel, joined to the interior major panel along the medial fold, each major panel having a lateral free edge and a longitudinal free edge, the longitudinal free edge being generally normal to the medial fold, the lateral free edge being spaced away from the medial fold and generally normal to the transverse off-fold;

an interior minor panel adjoining the interior major panel along the transverse off fold; and an exterior minor panel adjoining the interior minor panel along the medial fold and the exterior major panel along the transverse off-fold, each interior minor panel having a lateral free edge and a longitudinal free edge, the longitudinal free edge being generally normal to the medial fold, the lateral free edge being spaced away from the medial fold and generally normal to the transverse off-fold;

each of the interior sheet in the array having:

the major panels of at least one other sheet in the array interleaved between the major panels and minor panels of the interior sheet, the medial fold of the other sheet being adjacent the lateral free edges of the interior sheet, and the longitudinal free edges of the other sheet being adjacent the transverse off-fold of the interior sheet; and the minor panels of a third sheet interleaved between the major panels of the interior sheet and the major panels of the other sheet.

In one embodiment, a folded sheet material comprises a centrally located medial primary fold formed therein and a secondary off-fold transverse thereto, the medial fold and the transverse off-fold defining four panels in each sheet:

an interior major panel;

an exterior major panel, joined to the interior major panel along the medial fold, each major panel having a lateral free edge and a longitudinal free edge, the longitudinal free edge being generally normal to the medial fold, the lateral free edge being spaced away from the medial fold and generally normal to the transverse off-fold;

an interior minor panel adjoining the interior major panel along the transverse off fold; and an exterior minor panel adjoining the interior minor panel along the medial fold and the exterior major panel along the transverse off-fold, each interior minor panel having a lateral free edge and a longitudinal free edge, the longitudinal free edge being generally normal to the medial fold, the lateral free edge being spaced away from the medial fold and generally normal to the transverse off-fold.

The above described and other features are exemplified by the following Figures and detailed description.

BRIEF DESCRIPTION OF THE DRAWINGS

Referring to the exemplary drawings wherein like elements are numbered alike in the several Figures.

DETAILED DESCRIPTION

Figure 1:
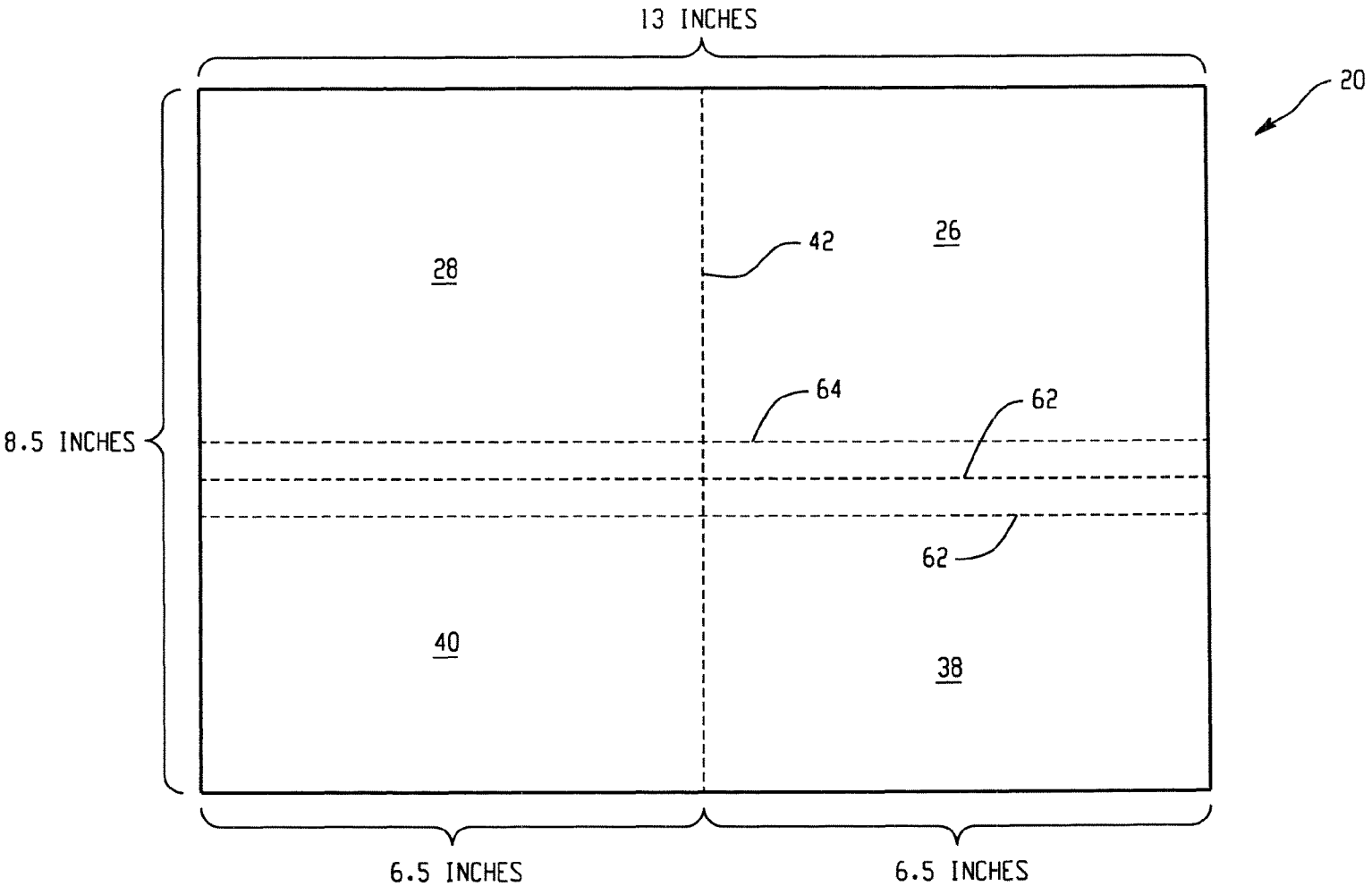
FIG. 1 is a layout of an unfolded (opened) napkin illustrating the location of the medial and transverse fold lines.

Disclosed herein are folded sheet materials and arrays of folded sheet materials. The term "fold sheet material" is being used to generically describe any folded web product. While reference is made throughout this application to napkins as an exemplary embodiment for ease in discussion, it is to be understood that the term folded sheet material can include, but is not limited to napkin, tissue, and towel. The substrate material for the sheet material can be any suitable material including but not limited to, paper and non-wovens (e.g., air-laid, spunbond, hydroentangled and double re-crepe).

In one embodiment, a paper napkin, when unfolded (opened), has an aspect ratio of about 1.1 to about 1.7, more specifically about 1.4 to about 1.6, while the width of the minor panels is about 60 to about 95% of the width of the major panels, more specifically about 60 to about 90% and still more specifically about 70% to about 90%. The napkin has a basis weight of between 11 and 17 pounds (lbs)/3000 squared foot ($ft^2$), more specifically between 12 and 16 lbs/3000 $ft^2$. In some embodiments, the open size of the napkin is between 8 inches×11 inches and 10 inches×14 inches. For example, in one embodiment, the napkin can have an unfolded size of 13 inches×8.5 inches. It is to be understood that these sizes are nominal measurements in which a person of skill in the art will understand that there may be some variance in dimensions due to manufacturing variances.

While the unfolded dimensions of a napkin are important to some end users, it has unexpectedly been discovered that a significant number of end users never even unfold a folded napkin. Indeed, users often grab a handful of napkins from dispensers and use the outer surface of the napkins to wipe their hands and mouths without ever unfolding the napkins. In these instances, a significant portion of the napkin goes unused, which results in a greater number of napkins being used by the end user. It has been discovered that a napkin with folded dimensions similar to currently available napkin folded dimensions, but with a smaller unfolded dimension, can reduce cost for the establishment purchasing the napkins, while still meeting the end users needs in many situations.

Georgia-Pacific Consumer Products LP currently sells a product under the brands MORNAP napkin and MORNAP JR napkin, which have respective unfolded dimensions of 12 inches×17 inches and 13 inches×12 inches. However, when these napkins are folded they both have folded dimensions of 5 inches×6.5 inches. There currently is a need in the market to service those customers that want a folded napkin at a reduced cost compared to current offerings. This need is met with the napkins disclosed herein. For example, in one embodiment, a four-panel napkin has an unfolded size of 13 inches×8.5 inches, with a folded dimension of 5 inches×6.5 inches A napkin having folded dimensions of 5 inches×6.5 inches advantageously allows the napkin to be used in many existing dispensers. The napkins can be placed on top of each other in an array for use in a dispenser. In a particular embodiment, discussed in greater detail below, the folded napkin can be interleaved to aid in "one-at-a-time" dispensing. The ability to dispense one napkin at a time is extremely desired by many establishments, as it helps mitigate wasted napkins. The combination of the napkin disclosed herein and the interleaved array of napkins offers folded napkin customers a reduced cost solution, while also providing a means to reduce napkin waste.

Referring now to FIG. 1, an exemplary napkin 20 is shown in an unfolded (opened) configuration illustrating the location of medial fold lines 42 and a range of suitable locations for transverse fold lines 62. As illustrated, the napkin 20 has an unfolded size of 13 inches×8.5 inches. It will be appreciated that medial fold 42 will at least very nearly divide napkin 60 in half, while transverse fold 62 will be formed in an "off-fold" location at least slightly away from the medial transverse line 64 disposed so as to form off-fold minor panels 38 and 40 having a width of about 4.25 inches to 7.00 inches. For example, in the embodiment illustrated, minor panels 38 and 40 have a width of 6.5 inches.

Figure 2:
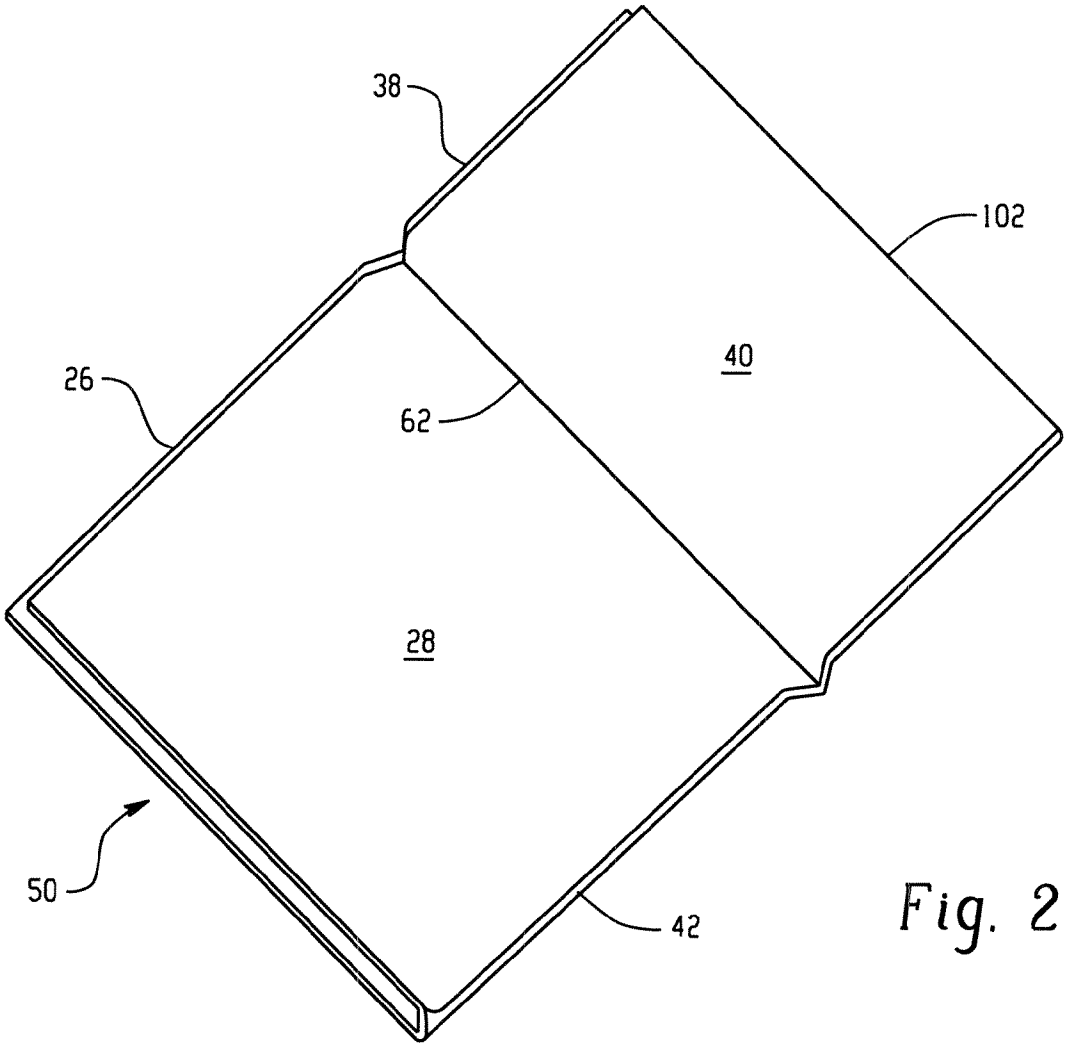
FIG. 2 is a schematic isometric perspective illustrating a pre-creased right hand napkin in which the medial fold has already been formed.
Figure 3:
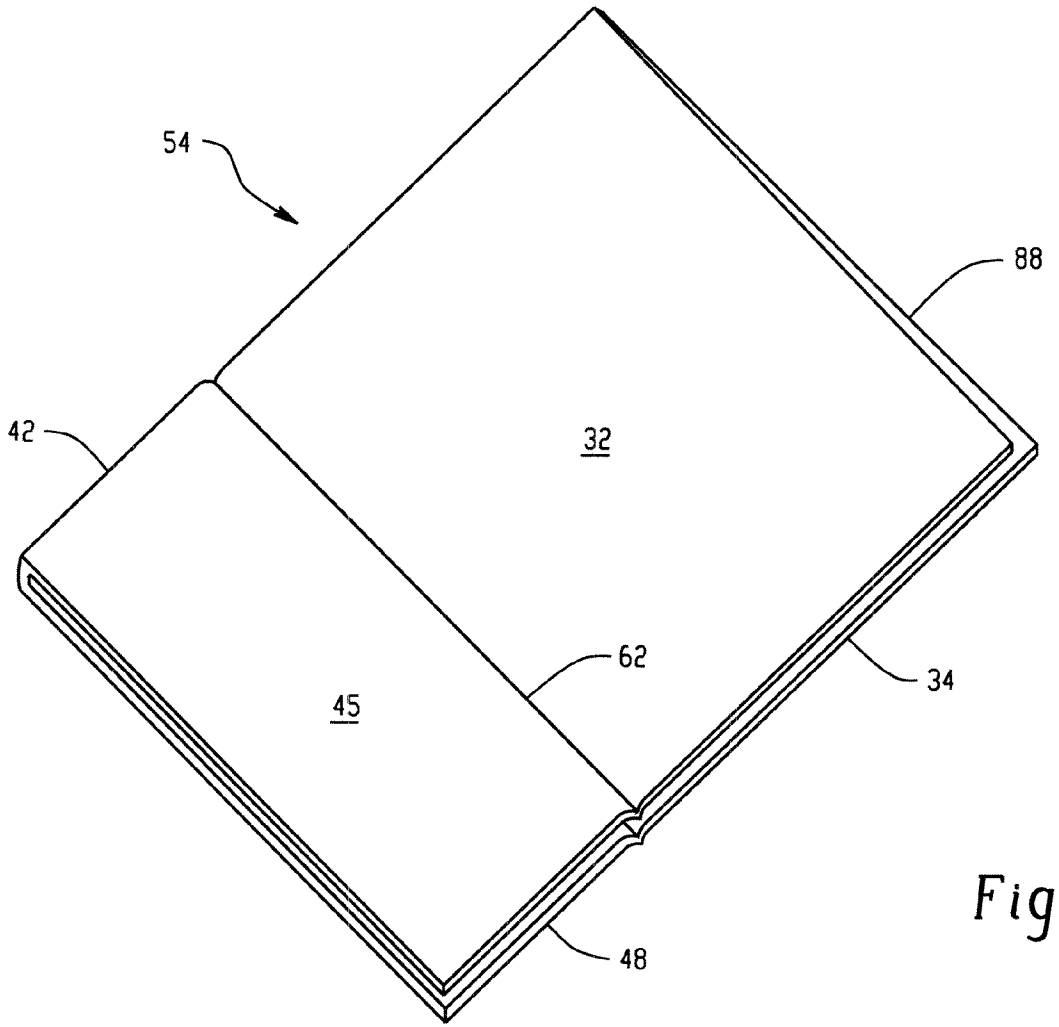
FIG. 3 is a schematic isometric perspective illustrating a pre-creased left hand napkin in which the medial fold has already been formed.

FIGS. 2 and 3 illustrate pre-creased "left-hand" napkins 54 and "right-hand" napkins 50 in which the medial fold has already been formed, it being understood that the difference between left-hand napkins 54 and right-hand napkins 50 is only in their orientation as they are placed into a napkin array, the terminology "left-hand" napkins being used for those napkins having the crease for transverse fold 62 on the viewers left as placed in napkin array, the respective napkins being superposable by mere rotation.

Figure 4:
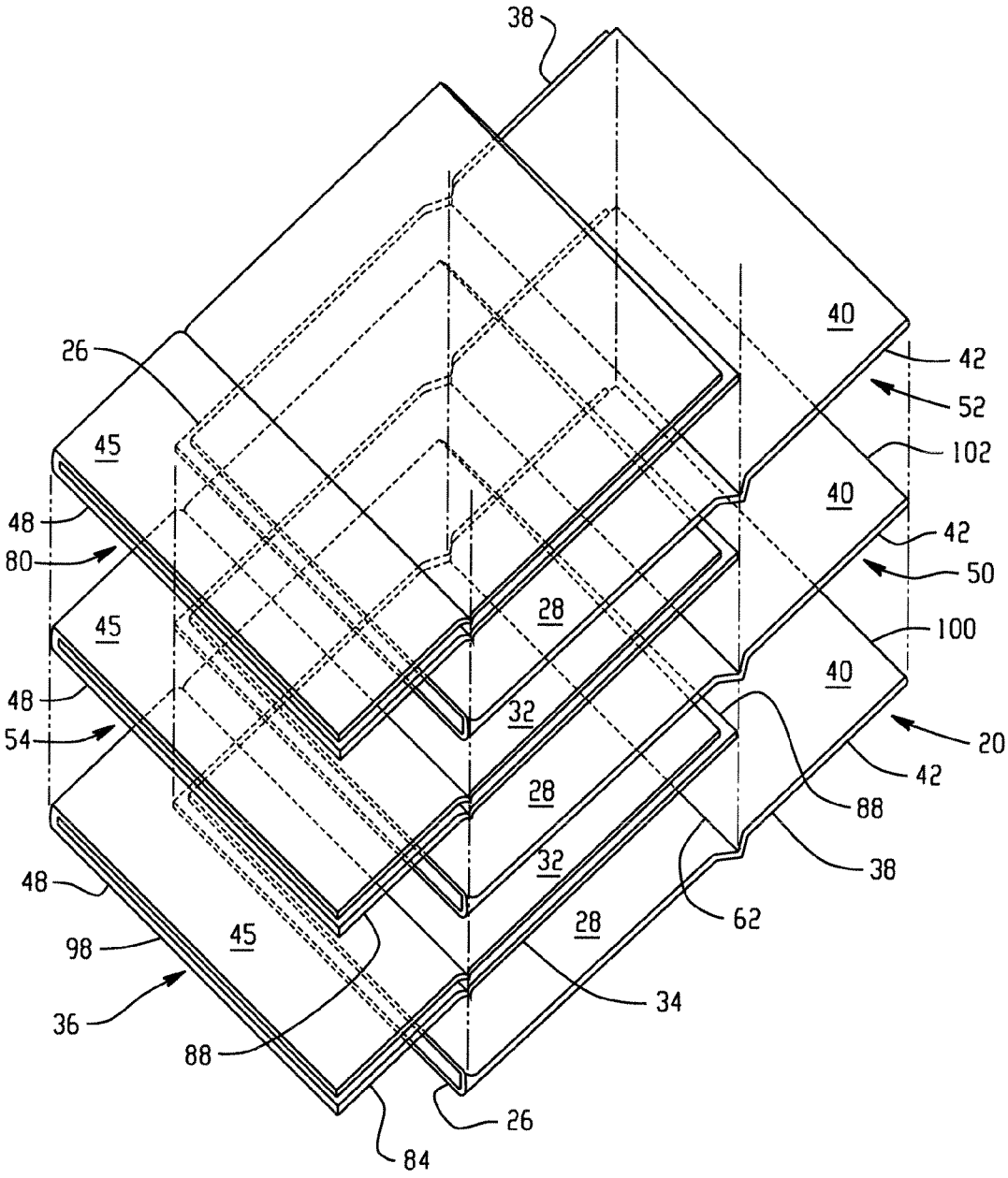
FIGS. 4 and 5 are exploded schematic isometric perspectives illustrating the interrelationship between the left hand and right hand napkins, particularly illustrating the relative locations of the free edges and various fold lines in napkins in the array.
Figure 5:
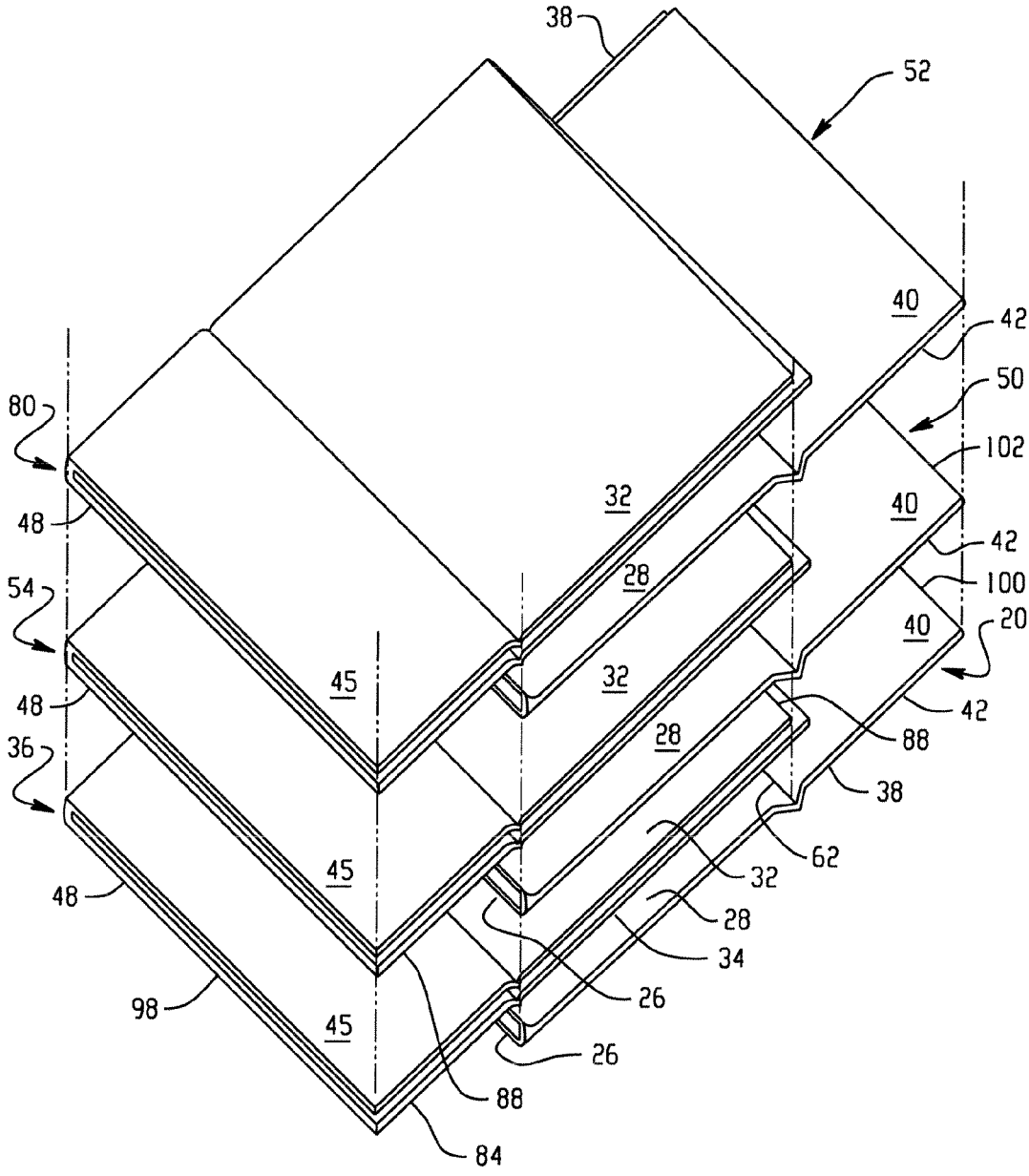

In one embodiment, the array of napkins has alternating "left-hand" and "right hand" napkins (e.g., see FIGS. 4 and 5). This embodiment advantageously can provide stability to the array of napkins, which can allow for greater packing density compared to other embodiments. However, other embodiments are envisioned where the array of napkins comprises all "left-hand" napkins, all "right-hand" napkins, a stack (e.g., at least two) "right-right" hand napkin followed by a stack of "left-hand" napkins, and various other combinations.

In FIG. 4 exploded isometric perspectives in phantom are presented illustrating three right-hand napkins 20, 50 and 52 and three left hand napkins 36, 54 and 80, with the relative locations of the free edges and various fold lines being visible whereas FIG. 5 illustrates the interrelationship between left hand napkins 36, 54 and 80 and right hand napkins 20, 50 and 52 as they are in essence stacked upon one another. In FIGS. 4 and 5, medial fold line 42 in the lower right corner of right hand napkin 20 underlays transverse free edge 84 of left hand napkin 36 directly thereabove whilst transverse fold 42 of right hand napkin 50 underlies longitudinal free edge 88 of left hand napkin 54. As array 21 is assembled, minor panels 38 and 40 of right hand napkin 20 will be folded over major panels 32 and 34 of left hand napkin 36. Thereafter, major panels 26 and 28 of right hand napkin 50 will be placed over minor panels 38 and 40 of right hand napkin 20 as well as the exposed portion of major panel 32 of left hand napkin 36. In turn, minor panels 45 and 48 of left hand napkin 36 are folded over major panels 26 and 28 of right hand napkin 50 generally aligning longitudinal free edge 98 of left hand napkin 36 with longitudinal free edges 100 and 102 of right hand napkins 20 and 52 above and below longitudinal free edge 98 of left hand napkin 54 but separated therefrom by major panels 28 and 26 of right hand napkin 50 and major panels 32 and 34 of left hand napkin 54 respectively. In this fashion, array 21 of any convenient number of napkins may be formed by repetition of the appropriate steps. In one embodiment the array of napkins comprises 600 to 900 napkins However, it is to be understood that a lesser or greater number of napkins can be employed in other napkin array embodiments.

Figure 6:
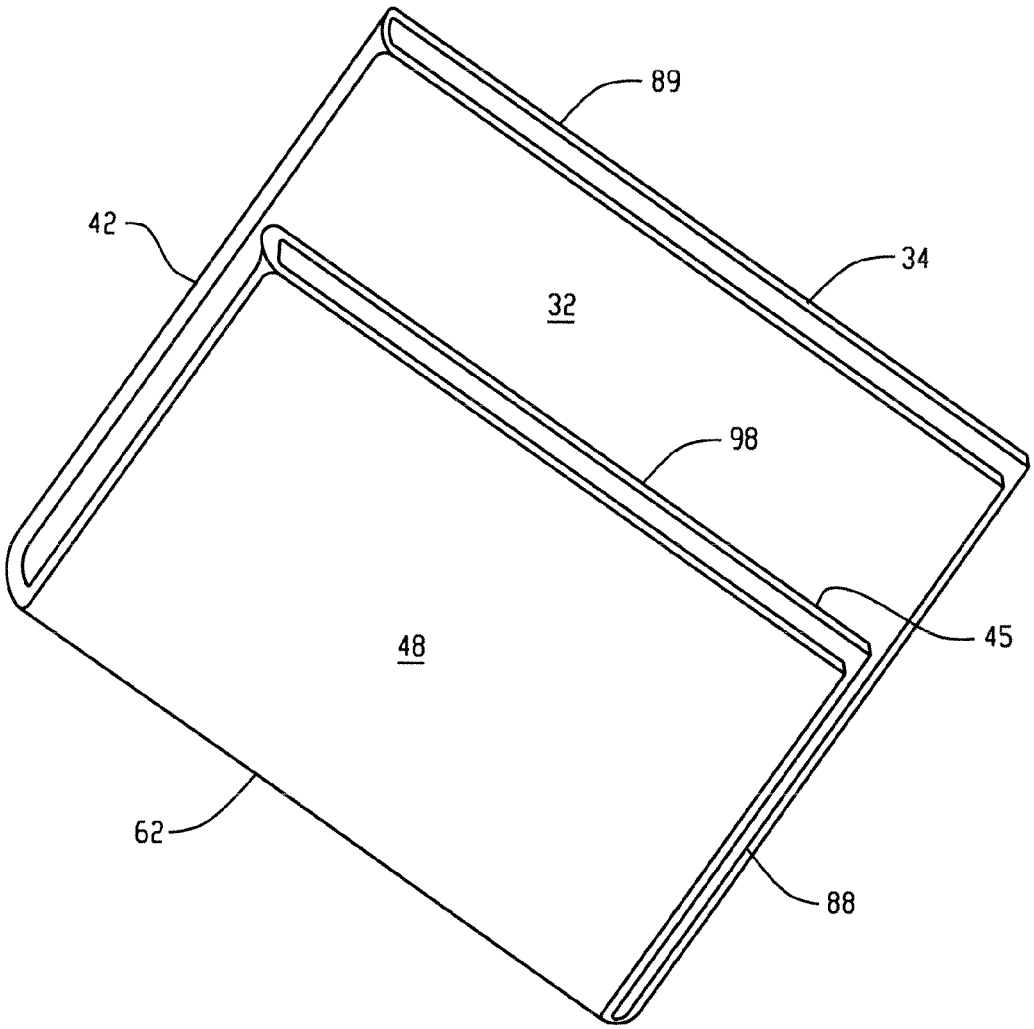
FIG. 6 is a schematic isometric perspective illustrating left hand napkins in which both the medial fold and the transverse form has been formed.
Figure 7:
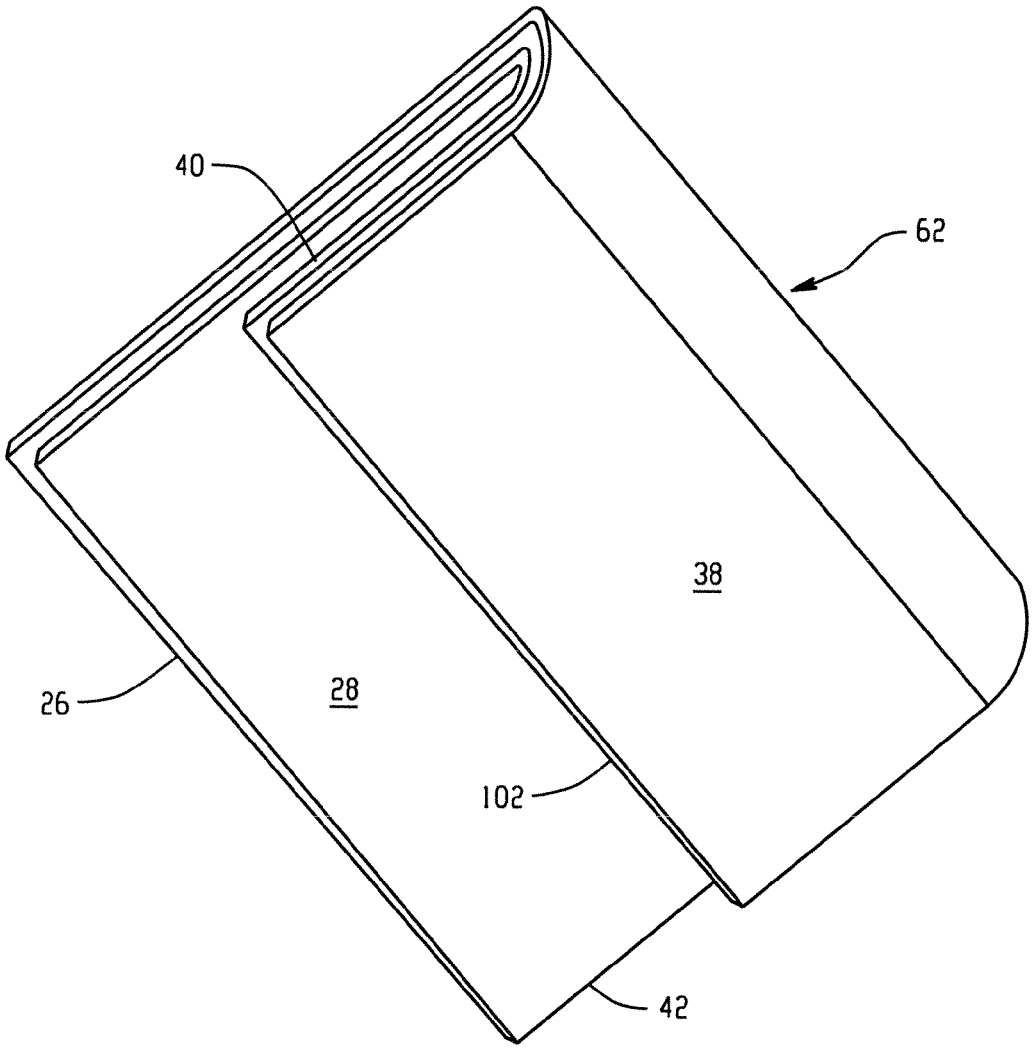
FIG. 7 is a schematic isometric perspective illustrating right hand napkins in which both the medial fold and the transverse fold have been formed.
Figure 8:
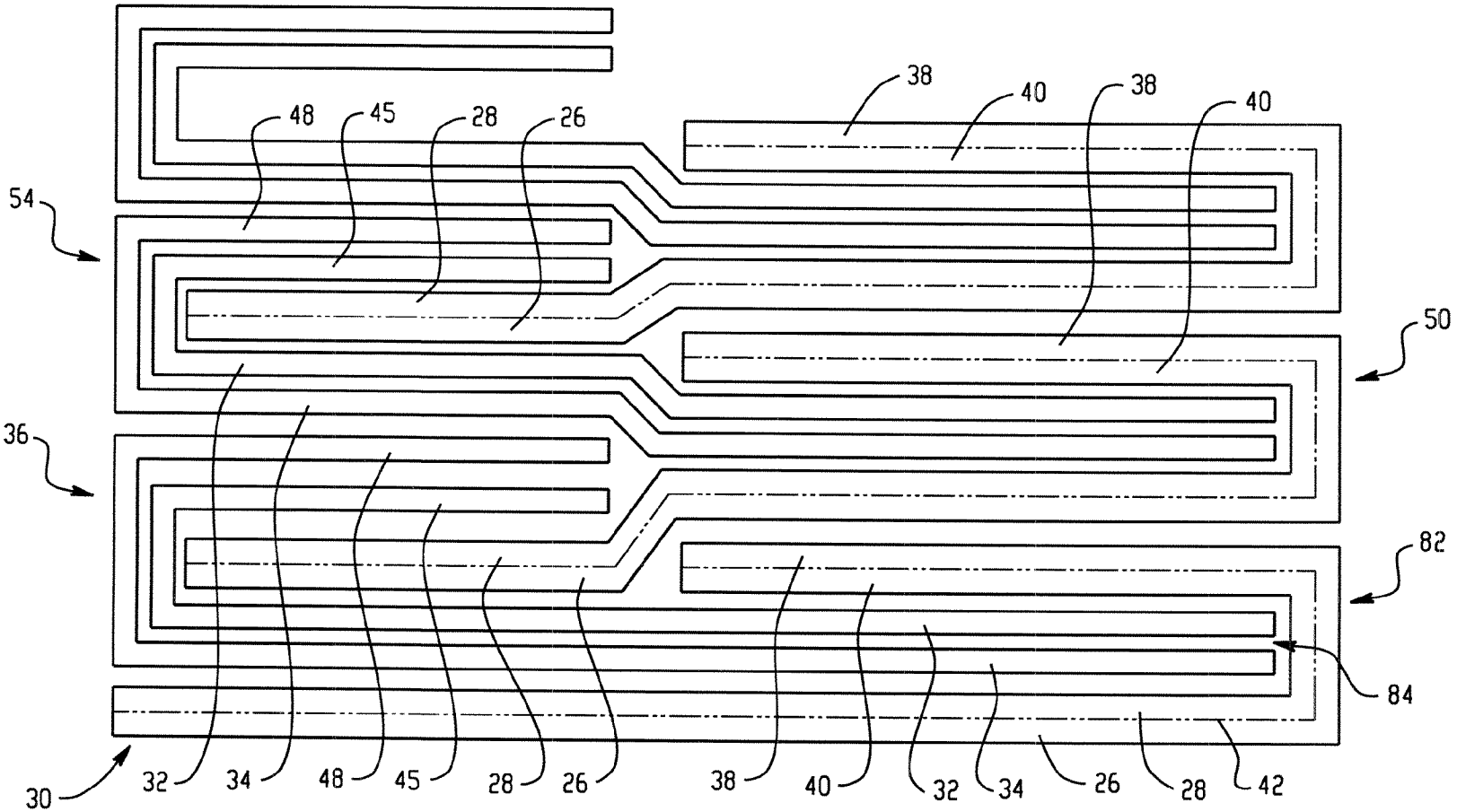
FIG. 8 is a schematic sectional view of an array of napkins illustrating how the various folds and panels are disposed relative to each other to provide a uniform density pack of napkins.

Even though napkins are shown flat in FIGS. 4 and 5, without transverse folds but only creases to mark their future location, during assembly of array 21, each napkin will be folded into the configurations shown in FIGS. 6 and 7 in which both the medial fold and the completed transverse fold are shown, prior to placement of the major panels of the napkin having the same hand above it in the array being placed over the minor panels thereof to form array 20. After the array is completed, the various folds and panels are disposed relative to each other to form a uniform density pack of napkins as schematically depicted in FIG. 8.

Figure 9:
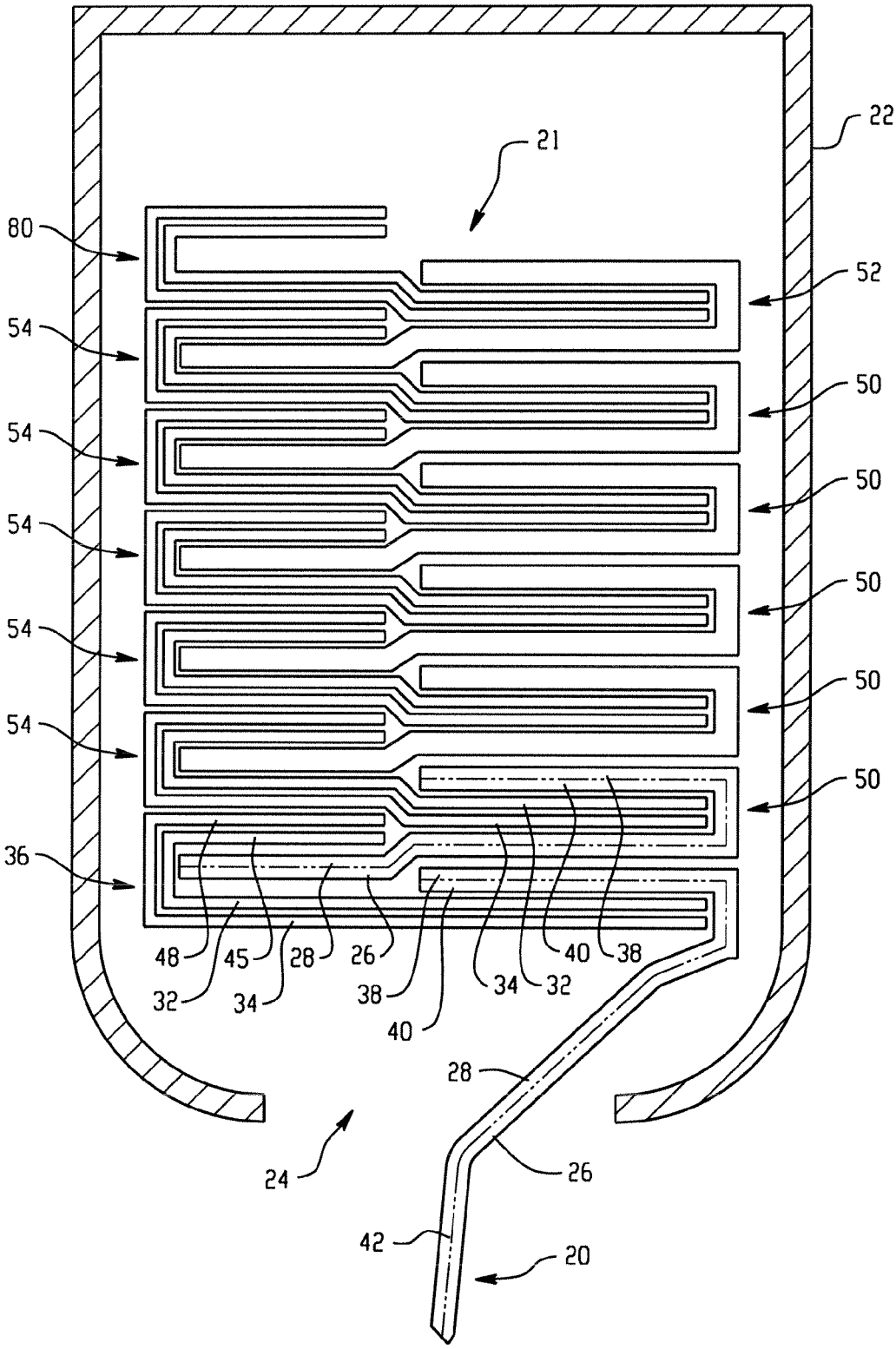
FIG. 9 is a schematic sectional view illustrating an array of napkin in a dispenser, particularly illustrating the interleaving of the napkins in the array.

In FIG. 9, an array 21 of napkins 20, 50, 52, 36, 54, 80 are disposed within dispenser 22, having opening 24 through which major panels 26 and 28 of initial napkin 20 in array 21 protrudes. Major panels 32 and 34 of left hand interior napkin 36 are disposed between major panels 26 and 28 and minor panels 38 and 40 of initial napkin 20. Inasmuch as napkin array 21 is shown from the near end, medial folds 42 of right hand napkins 20, 50 and 52 are presented to the viewer with the respective panels being located therebehind. Major panels 26 and 28 of each right hand interior napkin 50 are disposed between major panels 32, 34 and minor panels 45, 48 of each left hand interior napkin 54, the same interleaving applying to all of the interior napkins 50 and 54 in array 21.

Advantageously, napkin embodiments are disclosed herein that have a smaller unfolded surface area compared to many current commercial offerings, while having the same folded configuration. These napkins result in a napkin with a reduced cost that is still able to meet the customers' needs. Also, embodiment of napkin arrays disclosed herein advantageously allow for one at a dispensing.

While the disclosure has been described with reference to an exemplary embodiment, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

What is claimed is:

1. An array of sheet materials, the array comprising a first sheet, a second sheet, and an interior sheet located between the first sheet and the second sheet, each sheet having a centrally located medial primary fold formed therein and a secondary off-fold transverse thereto, the medial fold and the transverse off-fold defining four panels in each sheet:

an interior major panel;

an exterior major panel, joined to the interior major panel along the medial fold, each major panel having a lateral free edge and a longitudinal free edge, the longitudinal free edge being generally normal to the medial fold, the lateral free edge being spaced away from the medial fold and generally normal to the transverse off-fold;

an interior minor panel adjoining the interior major panel along the transverse off fold; and an exterior minor panel adjoining the interior minor panel along the medial fold and the exterior major panel along the transverse off-fold, each interior minor panel having a lateral free edge and a longitudinal free edge, the longitudinal free edge being generally normal to the medial fold, the lateral free edge being spaced away from the medial fold and generally normal to the transverse off-fold;

each of the interior sheet in the array having:

the major panels of at least one other sheet in the array interleaved between the major panels and minor panels of the interior sheet, the medial fold of the other sheet being adjacent the lateral free edges of the interior sheet, and the longitudinal free edges of the other sheet being adjacent the transverse off-fold of the interior sheet; and the minor panels of a third sheet interleaved between the major panels of the interior sheet and the major panels of the other sheet.

2. The array of sheet materials of claim 1, wherein the width of each minor panel is about 60% to about 95% of the width of each major panel.

3. The array of sheet materials of claim 1, wherein each sheet has an aspect ratio of about 1.1 to about 1.7.

4. The array of sheet material of claim 1, wherein each sheet is a napkin.

* * * * *